US005429337A

United States Patent [19]

Poole

[11] Patent Number: 5,429,337

[45] Date of Patent: Jul. 4, 1995

[54] PORTABLE MINI-DESK

[76] Inventor: William L. Poole, 13502 Creek Springs Dr., Houston, Tex. 77083

[21] Appl. No.: 134,680

[22] Filed: Oct. 12, 1993

[51] Int. Cl.[6] ..... B41J 11/02

[52] U.S. Cl. ..... 248/442.2; 248/918

[58] Field of Search ..... 248/441.1, 442.2, 118, 248/918, 633; 108/28; 400/682

[56] References Cited

U.S. PATENT DOCUMENTS

| | | | |
|---|---|---|---|
| 2,621,807 | 12/1952 | Rendich | 269/54.5 |
| 2,714,544 | 8/1955 | Abrahamson | 248/633 X |
| 4,561,619 | 12/1985 | Robillard | 248/918 X |
| 4,634,893 | 1/1987 | Nelson | 248/918 X |
| 4,863,124 | 9/1989 | Ball | 248/918 X |
| 4,893,775 | 1/1990 | Long | 248/442.2 |
| 5,058,840 | 10/1991 | Moss | 248/430 X |
| 5,062,609 | 11/1991 | Hames | 400/682 |
| 5,074,511 | 12/1991 | Wilson | 108/28 X |
| 5,104,086 | 4/1992 | Ramey | 248/442.2 |
| 5,253,836 | 10/1993 | Tso | 248/442.2 X |

*Primary Examiner*—J. Franklin Foss
*Attorney, Agent, or Firm*—Harrison & Egbert

[57] ABSTRACT

A portable mini-desk having a body with a generally flat surface thereon and a front end and a back end, a legless pad positioned on an underside of the body, and a weight-bearing member affixed to a back end of the body. The body has a support structure extending upwardly therefrom adjacent the back end of the body. The weight-bearing member includes a pin extending outwardly from the support structure. A document holder member is affixed to the body generally adjacent the back end of the body. The document holder member is affixed to a support structure extending upwardly from the flat surface. The document holder member is affixed in cantable relationship to the support member. A mouse pad is removably connected to the support structure and extends outwardly from one side of the body.

14 Claims, 9 Drawing Sheets

PORTABLE MINI-DESK

TECHNICAL FIELD

The present invention generally relates to furniture. More particularly, the present invention relates to desks which are useful in the office environment. The present invention also relates to portable desks having surfaces suitable for the receipt of computer keyboards and mice.

BACKGROUND ART

A desk is a piece of furniture designed for reading or writing. Many desks of all periods have had a sloping top to support reading or writing material. In Byzantine times a combination desk and lectern was used that consisted of a flat-topped cupboard from which rose a lectern on a stand. An early desk, used in the Middle Ages, was called a writing box. It stood on a table and, because it could be moved easily, it was sometimes taken on journeys. Some writing boxes were fitted with drawers and letter holes. Most lids were hinged either at the front or back, those hinged at the front often supported in a horizontal position by slides that could be pulled out of the framework, by hinged stays fixed inside the lid, or by a combination of both.

A great variety of desks were made in the 18th century, particularly in France, where the habit of writing little notes became something of a social mania. Many desks contained ingenious mechanical devices. In the Musee des Arts Decoratifs in Paris, for example, there is a flat desk with a top that folds forward while a tier of drawers rises at the back. Two similar types, in use in mid-18th century, are the cylinder top and the roll top desks. The cylinder top was a rigid, quarter-circle shutter covering the interior. The top could be slid back into the body of the desk while, at the same time, a writing surface might drawn forward. The roll top desk had a similar curved section, but it was made from strips of wood glued horizontally to a sheet of veneer. When the desk was opened, the strips were wrapped around a cylinder in the back. In England the kneehole desk was developed in the early 18th century. Its top was supported by two banks of cupboards, or drawers, separated by a space for the legs of the person seated at the desk. Larger versions, known as library tables, or sometimes, partners' desks, were created for two people, who sat facing each other.

In a modern office environment, there has become a need for the ability to properly use a computer keyboard in combination with a mouse on the desk. Whenever it is necessary to operate a computer for the purposes of word processing, for calculating, or for other procedures, it is virtually a requirement that any desk have the capacity to support a keyboard thereon. Often, when keyboards are used, it is desirable to have a document holder in a position adjacent to the keyboard so that the keyboard operator can properly view the material on the document holder. Additionally, it is desirable that a mouse pad be provided generally adjacent to the keyboard so that the operator of the computer can make the necessary adjustments and selections on the screen by the use of a mouse. Unfortunately, most computer desks are not well suited for the requirements of the office worker. Often, the worker must bend forward, away from the chair back, and towards the office desk at an awkward angle in order to use the computer keyboard. In any event, the user of the computer keyboard must be seated at a chair and positioned generally adjacent to an edge of the desk so that the computer can be properly operated.

The requirement that the computer keyboard operator be positioned adjacent to an edge of the desk causes a great deal of discomfort for many office workers. Many people have painful back problems that can limit the amount of time that he or she can sit with a poor posture adjacent to the edge of the desk. In other instances, the position of the keyboard, the mouse pad, the computer screen, and the document holder will make for an uncomfortable and awkward sitting and viewing arrangement for the operator. In certain circumstances, tendinitis and carpal tunnel syndrome can be caused by the awkward position at which the operator is seated relative to the keyboard and mouse. In general, the operator is advised against using "incorrect computing angles."

The present inventor is the owner of U.S. Pat. No. 4,552,419, issued on Nov. 12, 1985, and entitled "Mini-Desk". This patent describes a portable mini-desk that includes a body having a generally flat surface thereon, a first surface connected to the body and capable of canting with respect to that body, and controls arranged about the body so as to maintain the first surface in at least one fixed position. A turntable is interposed between the first surface and the body. This turntable has a generally circular shape. The body has a generally planar base, a plurality of vertical walls extending from the base, an upper surface generally parallel to the base, and an inclined surface extending from the upper surface. The controller is made up of a first geared member connected to the first surface, a second geared member disposed adjacent to the first geared member, an arm connected to the second geared member, and a lever connected to the arm. A spring is incorporated into the body so as to properly bias the arm. A telephone holder is cantably positioned about the body. The telephone holder includes a socket, a ball received by the socket, an elongate member fastened to the ball and extending from the socket, and an enclosure for holding a telephone.

After experimentation, the present inventor has found that this mini-desk desk of U.S. Pat. No. 4,552,419 accomplished many favorable results. The configuration of this mini-desk, however, is relatively expensive to manufacture and rather complicated to construct. Additionally, this mini-desk did not properly address the requirements of the modern day computer operator. As such, the present inventor has improved upon the configuration of the mini-desk of U.S. Pat. No. 4,552,419 so as to make the desk suitable for use with computer keyboards, mices, and document holders in optimal relation to computer screen viewing and the use of disk drives and printers.

It is an object of the present invention to provide a portable mini-desk that allows convenient access to a keyboard, a mouse pad, and a document holder.

It is another object of the present invention to provide a portable mini-desk that is convenient to use and maximizes ergonomic efficiency.

It is another object of the present invention to provide a portable mini-desk that minimizes back strain.

It is still another object of the present invention to provide a portable mini-desk that is adaptable for use in conjunction with computer equipment and other modern office equipment.

It is still another object of the present invention to provide a portable mini-desk that has a minimal weight through the proper selection of configuration and materials of construction.

It is still a further object of the present invention to provide a portable mini-desk that is relatively simple to manufacture, easy to use, and relatively inexpensive.

These and other objects and advantages of the present invention will become apparent from a reading of the attached specification and appended claims.

SUMMARY OF THE INVENTION

The present invention is a lightweight, portable mini-desk that comprises a body having a generally flat surface thereon with a front end and a back end, a legless pad positioned on an underside of the body, and a weight-bearing member affixed to a back end of the body. The body has a support structure extending upwardly therefrom adjacent the back end of the body. The body has a first support structure extending upwardly from the flat surface adjacent one side of the body and a second support structure extending upwardly from the flat surface adjacent an opposite side of the body. The weight-bearing member includes a first pin extending outwardly from the first support structure, and a second pin extending outwardly from the second support structure. Each of the first and second support structures has a plurality of holes formed on a surface above and opposite the flat surface. The first and second pins are removably received within the plurality of holes.

The flat surface has a plurality of pin-receiving openings formed therein. These pin-receiving openings removably receive pin members therein. The pin-receiving openings specifically include a first set of pin-receiving openings extending in linear alignment at least partially from the front end toward the back end adjacent one side of the body. A second set of pin-receiving openings extend in linear alignment at least partially from the front end toward the back end adjacent an opposite side of the body. A third set of pin-receiving openings extend in linear alignment at least partially from the back end toward the front end of the body. This third set is arranged between the first set and the second set.

The mini-desk of the present invention further includes a document holder member which is affixed to the body generally adjacent to the back end of the body. The document holder member is affixed to a support member extending upwardly from the flat surface. The document holder member is positioned above the flat surface. The document holder member is in cantable relationship to the support member and is positioned between the sides of the body.

A mouse pad is removably connected to the body and extends outwardly therefrom. Specifically, the mouse pad is removably connected to the first support structure and extends outwardly from one side of the body. The mouse pad is connected by a beam to the first support structure. In one embodiment, the beam has a frame at an end opposite the mouse pad. This frame is keyed to the body. The mouse pad is rotatably mounted to the beam. The mouse pad is in generally plane parallel relationship to the flat surface. In another embodiment, the mouse pad has a first arm extending outwardly therefrom. This first arm is in keyed relationship to a second arm extending outwardly from a side of the body. The second arm is hingedly connected to the body. The second arm is movable between a vertical stowed position and a horizontal deployed position.

The legless pad affixed beneath the body is made of a flexible foam (e.g. polyurethane) material. The legless pad has an area generally equal to an area of the flat surface.

DETAILED DESCRIPTION OF THE INVENTION

Figure 1:
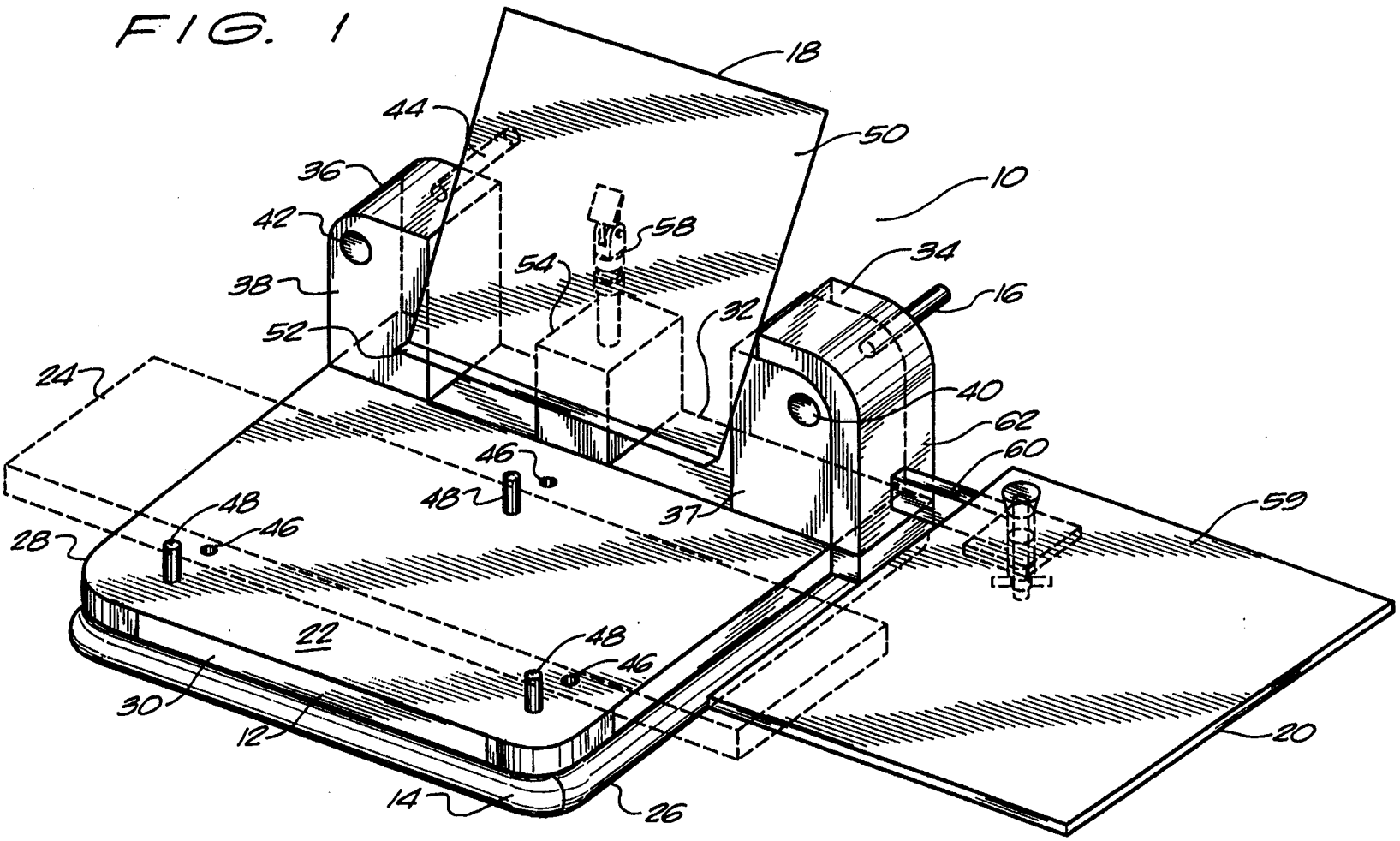
FIG. 1 is a perspective view of the mini-desk of the present invention.

Referring to FIG. 1, there is shown at 10 the portable mini-desk in accordance with the preferred embodiment of the present invention. The portable mini-desk 10 includes a body 12, a legless pad 14, a weight-bearing member 16, a document holder 18, and a mouse pad 20.

In FIG. 1, that the body 12 of the mini-desk 10 has a generally flat surface 22. In normal use, the flat surface 22 is the operating surface of the mini-desk 10. The flat surface 22 can be used for writing or for the receipt of computer keyboard 24. The arrangement of the computer keyboard 24 is illustrated in broken line fashion in FIG. 1. It can be seen that the computer keyboard 24 has a width which extends outwardly from the sides 26 and 28 of the body 12 of the mini-desk 10. The body 12 has a front end 30 and a back end 32. In general, the sides 26 and 28, along with the front end 30 and the back end 32 form the rectangular configuration for the body 12 of the mini-desk 10.

The body 12 includes a first support structure 34 and a second support structure 36 extending upwardly from the flat surface 22 adjacent to the back end 32 of the body 12. It can be seen that the first support structure 34 extends upwardly from the flat surface 22 generally adjacent to the side 26 of the body 12. The second support structure 36 extends upwardly from the flat surface 22 adjacent to the opposite side 28 of the body 12. The support structures 34 and 36 include abutment surfaces 37 and 38, respectively. The abutment surfaces 37 and 38 define a usable area of the flat surface 22 of body 12. Thumb holes 40 and 42 are formed in the abutment surfaces 37 and 38, respectively. The thumb holes 40 and 42 facilitate the proper manipulation and use of the mini-desk 10.

It can be seen that the weight-bearing member 16 is received on the opposite side of the first support structure 34 from the abutment surfaces 36. Specifically, the weight-bearing member 16 is a first pin which extends into one of a plurality of holes formed on the surface opposite the abutment surface 36. Similarly, a second pin 44 is received within one of a plurality of holes formed on the surface of the second support structure 36 opposite the abutment surface 38. The first pin 16 and the second pin 44 extend outwardly from the support structures 34 and 36, respectively. In normal use, the pins 16 and 44 can be used to "prop" the mini-desk 10 on an edge of a table, desk, or other office equipment. The pins 16 and 44 serve as load-bearing members so as to distribute the weight of the mini-desk 10 to another surface for the comfort, convenience, and efficiency of the user of the mini-desk 10.

In FIG. 1, it can be seen that the flat surface has a plurality of pin-receiving openings 46 formed thereon. The pin-receiving openings serve to receive pin members 48 therein. The arrangement of the pin-receiving openings 46 and the pin members 48 is described, in greater detail, in FIG. 2. Essentially, the pin members 48 can be positioned so as to properly accommodate and receive the keyboard 24 therebetween. The pins 48 can be manipulated so as to accommodate the various widths of the keyboard 24. The pins 48 serve to prevent the keyboard 24 from sliding across the flat surface 22. Pins 48 can be configured and positioned for the ease and convenience of the user of the mini-desk 10.

The legless pad 14 is positioned an an underside of the body 12. The legless pad 14 is made of a flexible foam (e.g. polyurethane) material. The legless pad 14 will, in normal use, rest on the lap of the user. The pad 14 is covered with a zippered case made from a soft material, such as vinyl or cloth. The pad 14 can be affixed to the underside of the body 12 by adhesives, buttons, VELCRO (TM), or by other means. In general, the pad 14 has an area generally corresponding to the area of the body 12. The pad 14 can be easily removed from the body 12 for the purpose of laundering the zippered case.

In FIG. 1, it can be seen that a document holder member 18 is affixed to the body 12 generally adjacent to the back end 32 of the body 12. The document holder member 18 has a generally flat surface 50 and a bottom support edge 52. The bottom support edge 52 extends across the bottom of the flat surface 50. The document holder member 18 is affixed to a support member 54 and extends upwardly from the flat surface 22 of body 12. As can be seen, the document holder member 18 is positioned above the flat surface 22. Through the use of a connection mechanism 58, the document holder member 18 is in cantable relationship to the support member 54. The document holder member 18 is positioned between the sides 26 and 28 of the body 12.

In FIG. 1, it can be seen that a mouse pad 20 is removably connected to the body 12 and extends outwardly therefrom. The mouse pad 20 extends outwardly from the side 26 of body 12. In FIG. 1, it can be seen that the mouse pad 20 has a generally flat surface 59. The mouse pad 20 is rotatably connected to an arm 60 extending toward the body 12. A frame 62 is affixed to the other end of arm 60 so as to secure the mouse pad 20 to the body 12. The frame 62 is removably secured to the first support structure 34 of body 12. The mouse pad 20 is configured so as to be in plane parallel relationship to the flat surface 22. The mouse pad 22 is positioned generally above the top surface 22 so as to accommodate the outwardly extending end 64 of the keyboard 24. The mouse pad 20 is rotatable and removable so as to be stowed properly when not in use. The mouse pad 20 is suitable for direct use with a mouse, without the need for an external mouse pad. Of course, the user may purchase a commercial mouse pad and place it on surface 59.

Figure 2:
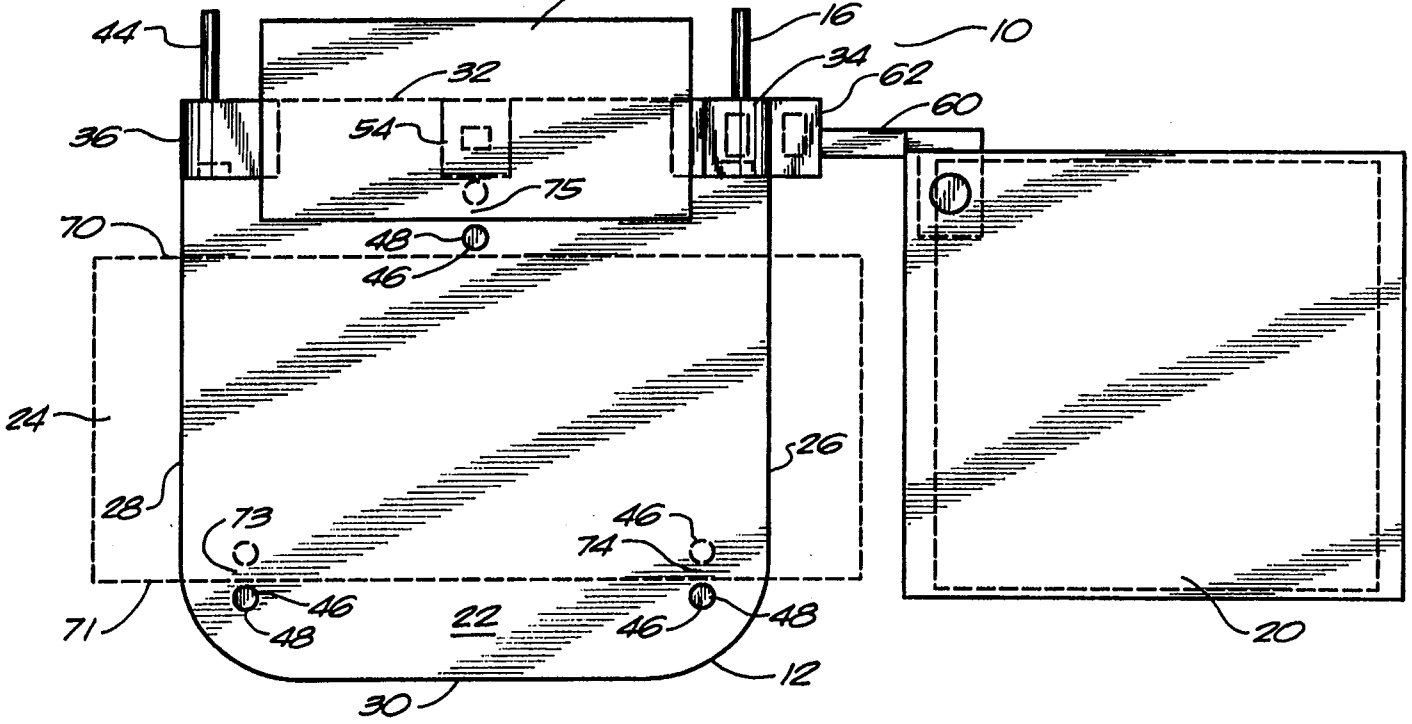
FIG. 2 is a plan view of the mini-desk of the present invention.

FIG. 2 is a top view of the mini-desk 10 of the present invention. In FIG. 2, it can be seen that the computer keyboard 24 is positioned on the top surface 22 of the body 12. The computer keyboard 24 has the back edge 70 and the front edge 71 secured between the pins 48 properly positioned in the pin-receiving openings 46. The pin-receiving openings includes a first set of pin-receiving openings 73 extending in generally linear alignment at least partially from the front end 30 toward the back end 32 of the body 12. The first set 73 is generally adjacent to the side 28 of the body 12. A second set of pin-receiving openings 74 extends in linear alignment at least partially from the front end 30 toward the back end 32 adjacent the opposite side 26 of the body 12. Finally, a third set 75 of pin-receiving openings 46 is positioned in linear alignment at least partially from the back end 32 toward the front end 30. This third set 75 is arranged between the first set 73 and the second set 74. This "triangular" configuration of pin-receiving openings 73, 74, and 75, along with the pins 48, creates an arrangement whereby the computer keyboard 24 can be properly positioned onto the top surface 22 of body 12.

In FIG. 2, it can be seen that the first pin 16 and the second pin 44 extend outwardly from the back end 32 of the body 12. These pins 16 and 44 are configured so as to be load-bearing members of the mini-desk 10. The document holder 18 is positioned on the support member 54 so as to be angularly positioned adjacent to the computer keyboard 24. Additionally, in FIG. 2, it can be seen that the mouse pad 20 extends outwardly from the side 26 of body 12. Arm 60 and frame 62 serve to connect the mouse pad 20 with the first support structure 34.

Figure 3:
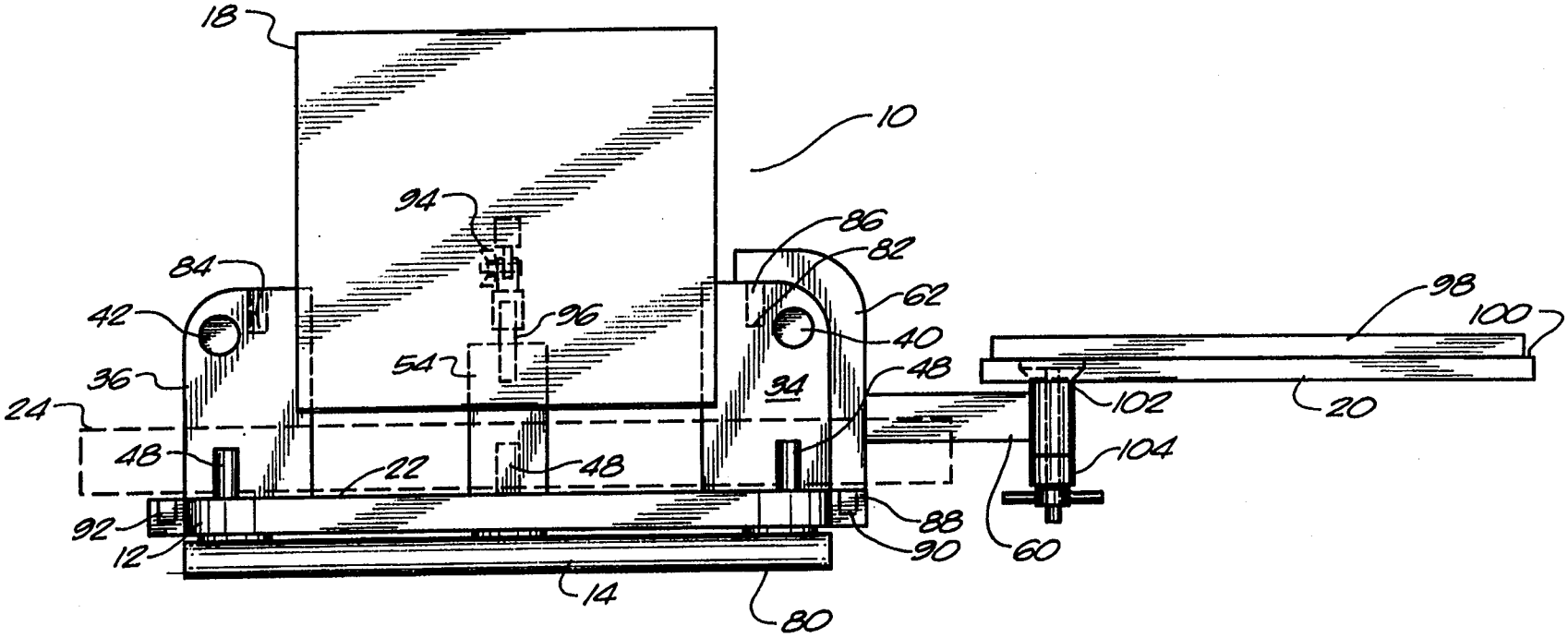
FIG. 3 is a front elevational view of the mini-desk of the present invention.

In FIG. 3, the mini-desk 10 is shown in its frontal view. The mini-desk 10 includes the body 12, the legless pad 14, the document holder 18 and the mouse pad 20. The legless pad 14 is shown as having a bottom surface 80 opposite the bottom of the body 12. The bottom surface 80 of the pad 14 will rest on the legs of the user of the mini-desk of the present invention. The support structures 34 and 36 extend upwardly from the top surface 22 of the body 12. Thumb holes 40 and 42 are positioned adjacent the corners of the support structures 34 and 36, respectively. The document holder 18 is connected to the support member 54 above the top surface 22 of body 12.

In FIG. 3, it can be seen that the first support structure 34 includes a slot 82. The second support structure 36 includes a slot 84. The slot 82 receives a key 86 of the frame 62 of the mouse pad 20. The slot 84 is positioned on the second support structure 36 so as to accommodate the key 86 of frame 62 if the user of the mini-desk 10 is left handed. Under such an arrangement, the mouse pad 20 will extend outwardly from the side 28 of the body 12.

The pins 48 are shown as extending upwardly from the top surface 22 of the body 12. The pins 48 should have a height which is sufficient so as to restrict the sliding movement of the keyboard 24 positioned on the top surface 22. It can be seen that the body 12 includes a second slot 88 for receiving a second key 90 of the frame 62. The opposite side of the body 12 also includes a slot 92 for receiving the second key 90 if the user of the mini-desk 10 is left-handed.

In FIG. 3, the document holder 18 is affixed to a mechanism 94 that is supported on a pin 96. The pin 96 is secured within the support member 54. The arrangement of the mechanism 94 and the pin 96 allows the document holder 18 to be rotated, pivoted, and canted, as desired. The document holder 18 can be removed, if desired, from the support member 54.

The mouse pad 20 is a generally planar member that extends in plane parallel relationship to the body 12. Mouse pad 20 has a surface suitable for direct mouse use. Optionally, the user may purchase a commercially available mouse pad 98. The mouse pad surface 98 can be placed on the top surface 100 of the mouse pad 20. The surfaces 20 and 98 are high-friction surfaces so as to facilitate the proper action of a mouse. The mouse pad 20 is rotatably connected at 102 to a pivot mechanism 104. The pivot mechanism 104 is connected to the arm 60. Arm 60 is affixed to the frame 62 so as to support the mouse pad 20 in its proper position.

Figure 4:
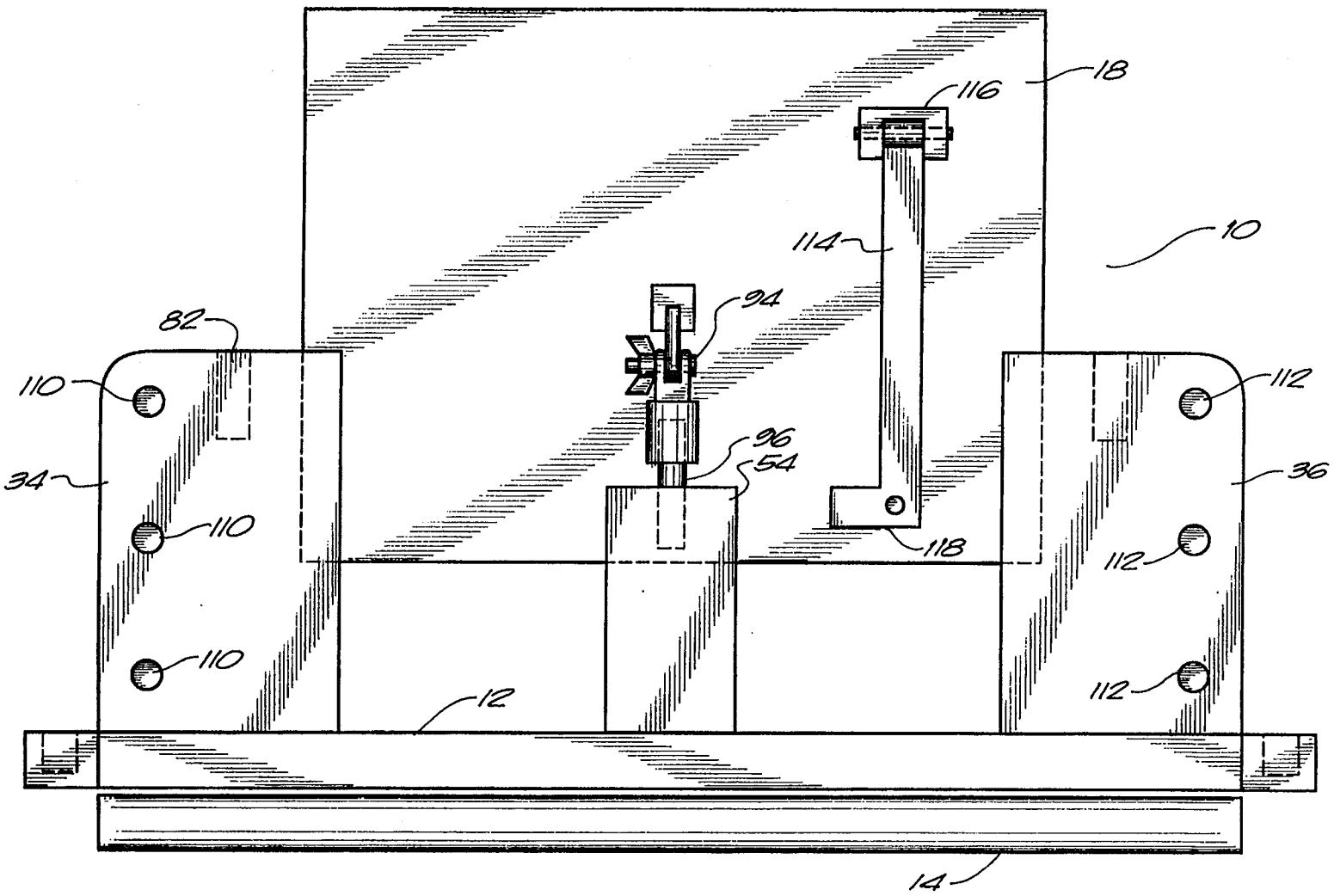
FIG. 4 is a back view of the mini-desk of the present invention.

FIG. 4 is an isolated view of the back side of the mini-desk 10. The mini-desk 10 includes the body 12, the pad 14, and the document holder 18. In FIG. 4, the first support structure 34 is shown as having a plurality of holes 110 extending therealong. The holes 110 are configured so as to receive the first pin 16 in various positions. The slot 82 is formed so as to receive the key of the frame 62 of the mouse pad 20. The second support structure 36 includes holes 112 formed therein. The holes 112 accommodate the second pin 44 in various positions. In normal use, the pins 16 and 44 can be positioned in the holes 110 and 112 so as to act as proper load bearing members for the body 12.

The document holder 18 employs the mechanism 94 on its back surface so as to facilitate the cantability of the document holder 18. The mechanism 94 is the type of mechanism that is manufactured by Kensington Corporation. The mechanism 94 is supported on a rod 96 on the support member 54. A support arm 114 is pivotably connected to a bracket 116 on the back side of the document holder 18. The support arm 114 has a bottom 118. When the arm 114 is rotated about the bracket 116, the arm will extend outwardly in a position whereby the document holder 18 can be removed and supported upright on another surface. The mechanism 94 is removably received from rod 96, supported within the support member 54.

Figure 5:
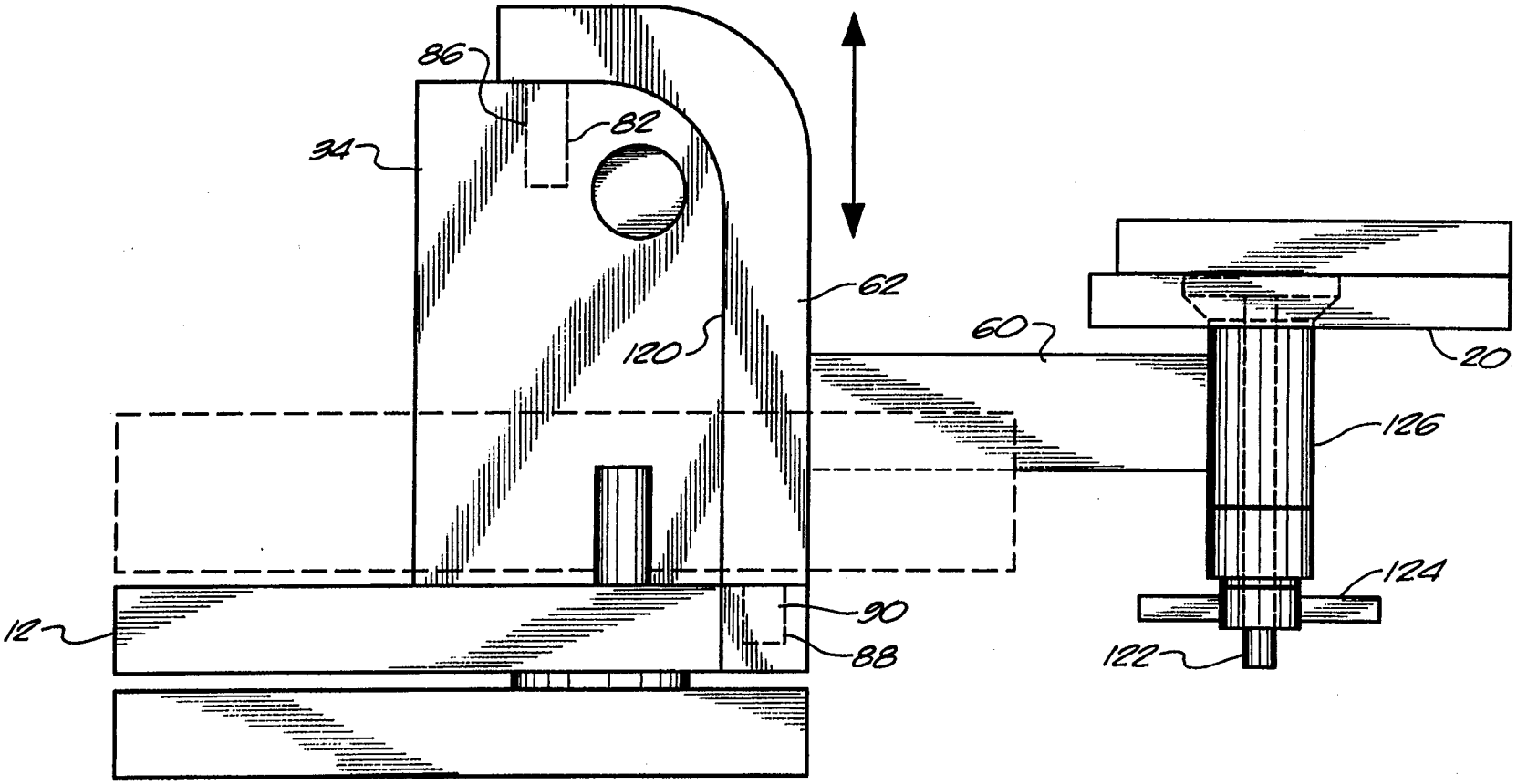
FIG. 5 is a front view of an alternative embodiment of the mouse pad arrangement for the mini-desk of the present invention.

FIG. 5 shows the preferred embodiment of the connection of the mouse pad 20 to the first support structure 34 of body 12. In particular, the mouse pad 20 is connected by the arm 60 to the frame 62. The frame 62 includes a first key 86 that is received within the slot 82 formed at the first support structure 34. A second slot 88 is formed in the body 12 so as to receive the second key 90 at the bottom of the frame 62. The frame 62 has an inner surface 120 that fits to the contour of the exterior surface of the first support structure 34. When the frame 62 is properly received within the slots 82 and 88, the arm 60 will be maintained in a rigid position extending outwardly from the body 12. The mouse pad 20 is connected to a rod 122 that extends vertically downwardly therefrom. The rod 122 is affixed by clamp member 124 at the bottom of the cylindrical support 126. In this manner, the mouse pad 20 can freely rotate relative to the arm 60. When it is desired to remove the mouse pad 20, the frame 62 can be simply moved upwardly vertically such that the keys 86 and 90 are removed from the slots 82 and 88, respectively.

Figure 6:
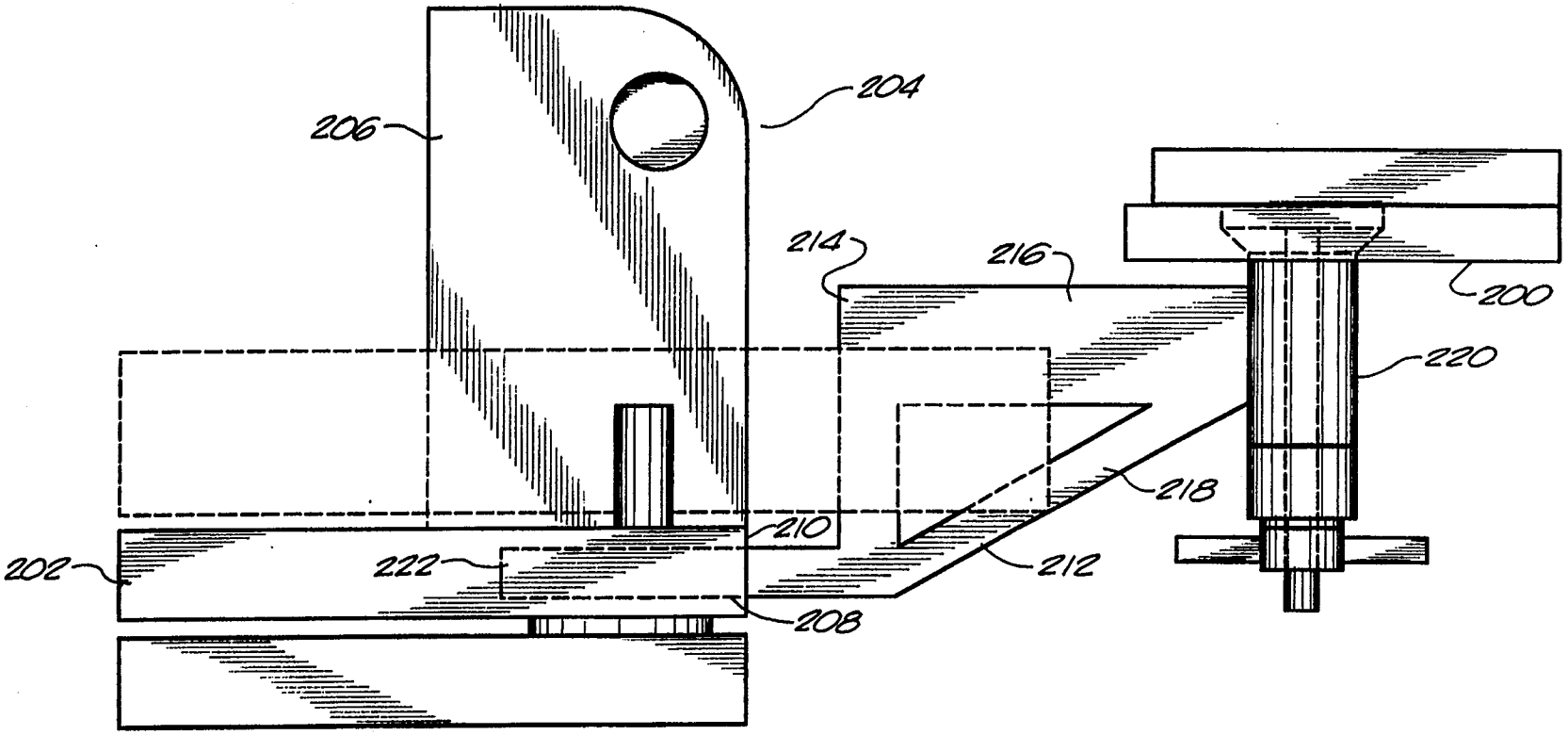
FIG. 6 is a frontal view of a second alternative embodiment of the mouse pad arrangement of the mini-desk of the present invention.

FIG. 6 shows an alternative embodiment whereby the mouse pad 200 can be properly secured to the body 202 of the mini-desk 204. The support structure 206 extends upwardly from the body 202. A slot 208 is formed so as to extend horizontally into the body 202 from the side 210. Slot 208 will have a rectangular configuration so as to prevent rotational movement between the arm 212 and the body 202. The slot 208 is positioned below the support structure 206. The arm 212 has a generally rectangular configuration having, in particular, a vertical member 214, a horizontal member 216, and a diagonal member 218. The horizontal member 216 and the diagonal member 218 are secured to the cylindrical body 220 which supports the mouse pad 200 in a horizontal position in plane parallel to the body 202. In order to remove the mouse pad 200, it is only necessary to pull the mouse pad 200 horizontally to the right so that the key 222 is removed from the slot 208.

Figure 7:
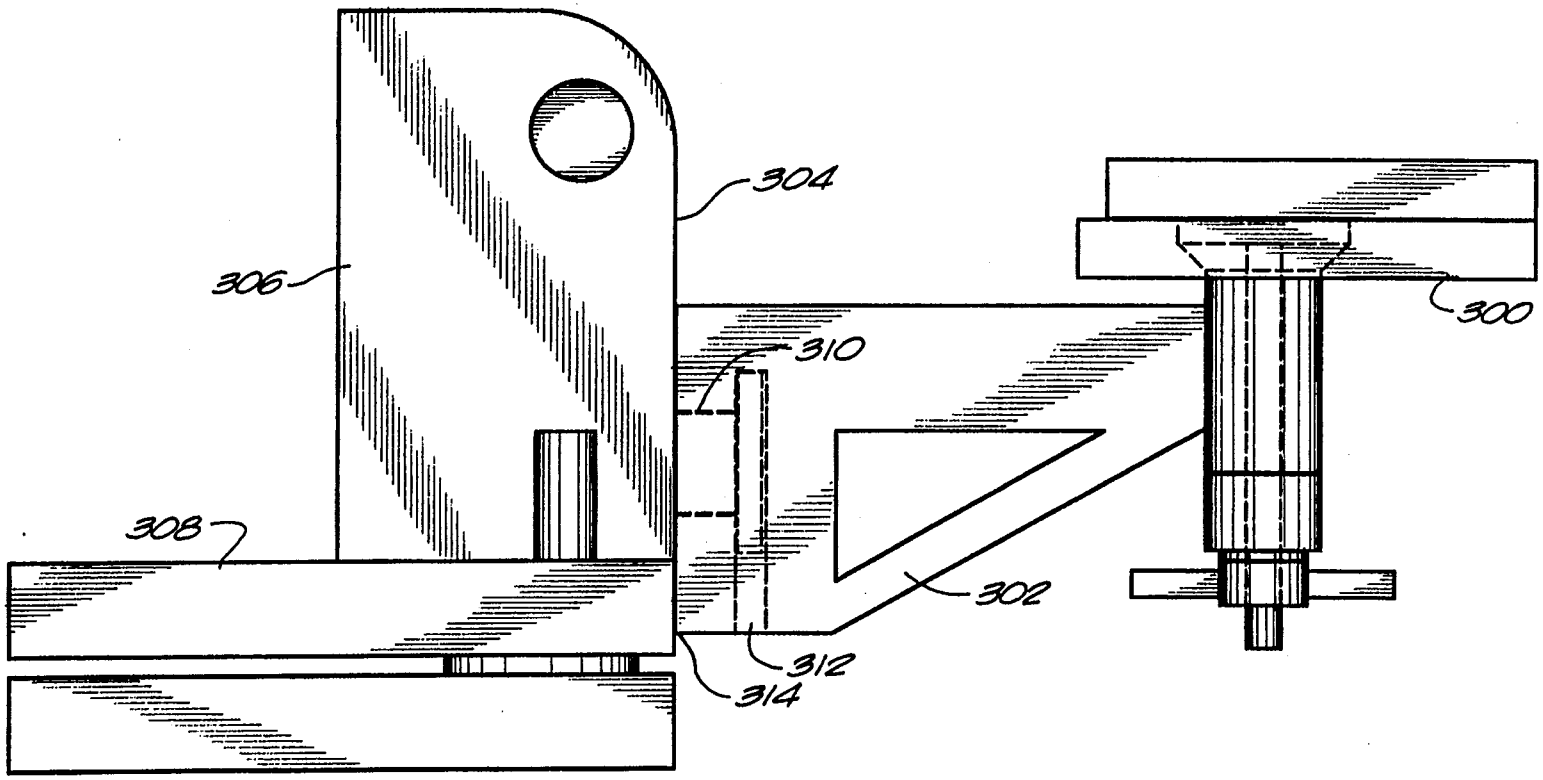
FIG. 7 is a third alternative embodiment of the mouse pad arrangement of the mini-desk of the present invention.

FIG. 7 shows a third alternative embodiment of the mouse pad 300 of the present invention. Mouse pad 300 has an arm 302 that extends toward the side 304 of the support structure 306 of the body 308. An I-beam key 310 is affixed to the side 304 of the support structure 306. A slot 312 is formed on the end 314 of the arm 302. The slot 312 slides over the I-beam key 310 so that the arm 302 is secured in abutment against the side 304 of the support structure 306. The arm 302 has a configuration similar to the arm 212 of FIG. 6. In order to remove the mouse pad 300, it is simply necessary to lift the arm 302 so that the I-beam key 310 slides outwardly through the bottom of the slot 302.

Figure 8:
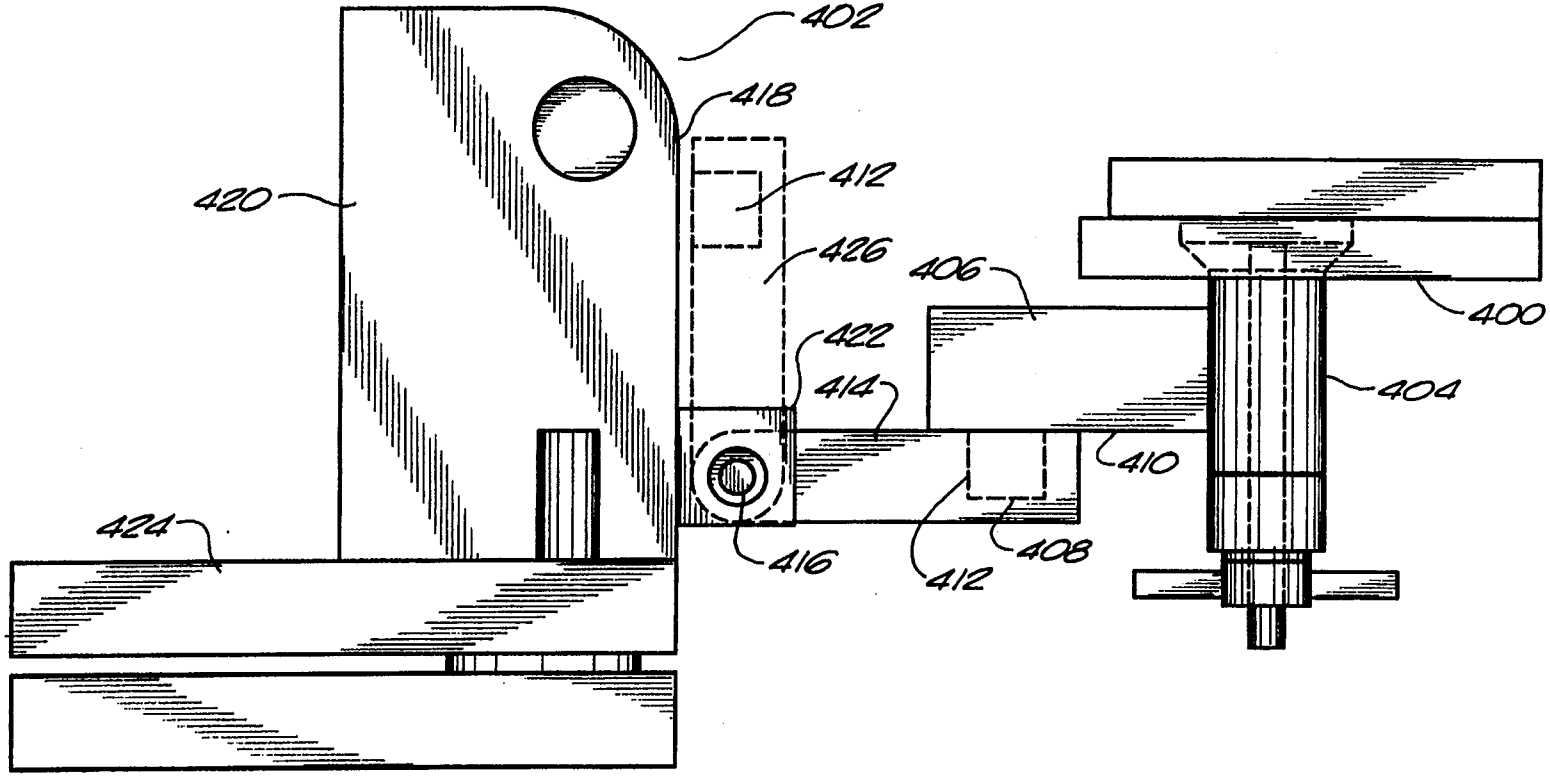
FIG. 8 is a fourth alternative embodiment of the mouse pad arrangement of the mini-desk in accordance with the present invention.

FIG. 8 shows a fourth alternative embodiment of the mouse pad 400 of the mini-desk 402 of the present invention. The mouse pad 400 is connected to the cylindrical body 404 in the manner described in the previous embodiment of the present invention. A first arm 406 extends outwardly from the cylindrical body 404. This first arm 406 has a key 408 positioned on its bottom surface 410. The key 408 is removably received within a slot 412 formed on a second arm 414. The second arm 414 is hingedly connected at 416 to a side 418 of the support structure 420. A housing 422 is connected around the hinge 416 so as to limit the travel of the second arm 414 with respect to the body 424. The second arm 414 is movable between a first vertical stowed position 426 and a second horizontal deployed position. The stowed position is illustrated in broken-line fashion in FIG. 8. In the deployed position, the slot 412 receives the key 408 so as to act as a receptacle for the mouse pad 400. In order to remove the mouse pad 400, it is only necessary to lift the key 408 from the slot 412. For convenience, the second arm 414 can be rotated about the hinge 416 to its stowed position adjacent to the side 418 of the support structure 420.

Figure 9:
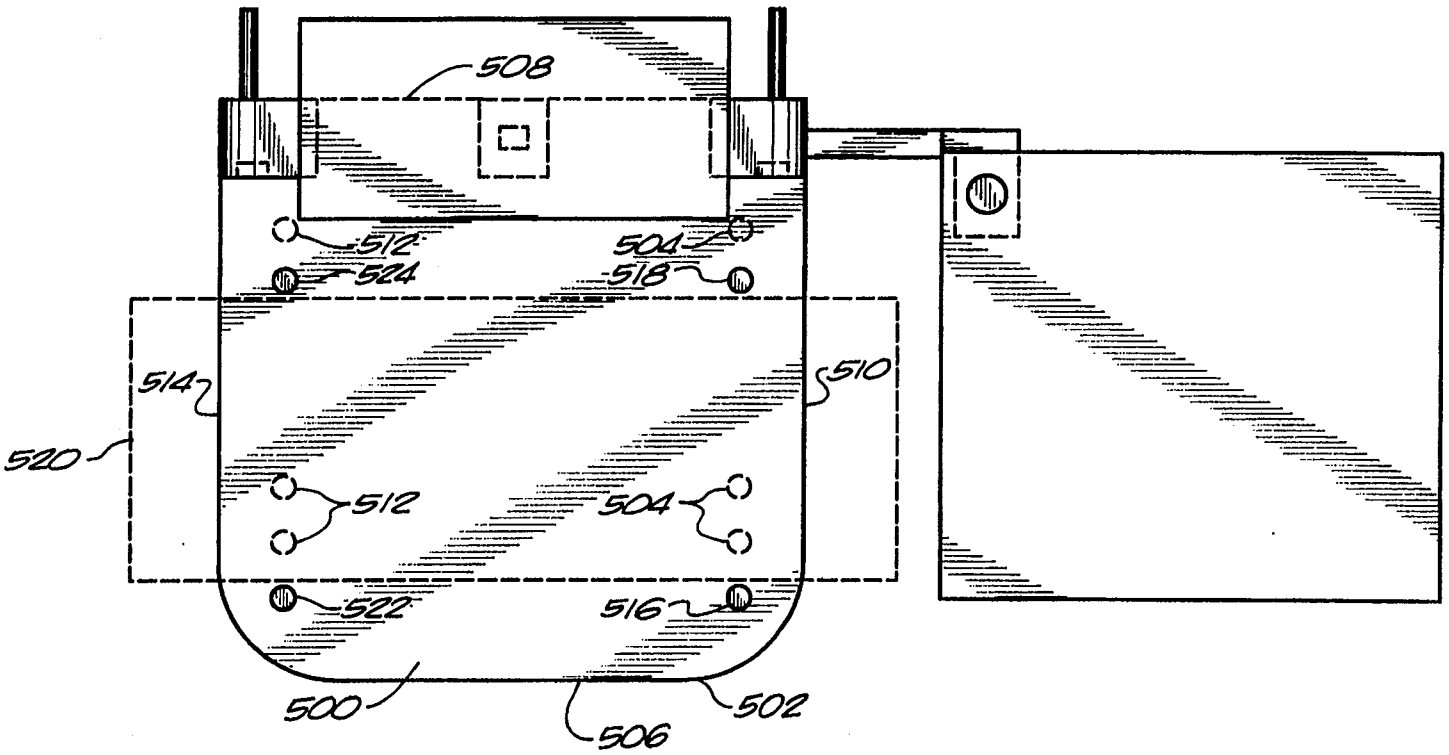
FIG. 9 is a plan view of the present invention showing an alternative arrangement of the pin-receiving openings on the flat surface of the mini-desk.

FIG. 9 shows an alternative configuration of the pins and pin-receiving openings on the flat surface 500 of body 502. There is a first set of pin-receiving openings 504 extending from the front 506 to the back 508 adjacent to one side 510 of body 502. A second set of pin-receiving openings 512 extends from the front 506 to the back 508 adjacent to an opposite side 514 of body 502. The first set of pin-receiving openings 504 receives a first pin 516 and a second pin 518. Pins 516 and 518 are spaced generally equal to the width of the keyboard 520. The second set of pin-receiving openings 512 receives a third pin 522 and a fourth pin 524. The third pin 522 and the fourth pin 524 are spaced generally equal to the width of keyboard 520. This arrangement allows for two rearward support positions, at least one of which is available for avoiding keyboard cable interference. This arrangement places all of the holes adjacent to the sides 510 and 514 so as to leave the center work area smooth.

The configuration of the present invention is ideally suited for the proper use of computer equipment. The flat surface of the body is an ideal area for the receipt of computer keyboard. In normal use, the body will be resting on the lap of the user so that the keyboard is in a convenient location for the user. Importantly, in the present invention, weight bearing members are provided at the back end of the body so as to assist the user and to remove some of the weight of the computer keyboard, of the mini-desk, and of the mouse pad from the lap of the user. By placing the mini-desk on the lap of the user, the user can lean backwardly or at any angle that is convenient and comfortable. With the present invention, the user can relax comfortably while carrying out the necessary tasks on the computer keyboard. The mouse pad is positioned at a desirable location for either left-handed or right-handed users. If it is not desired to use a mouse pad, then the mouse pad can be easily removed from the body of the mini-desk and stored, as required. The document holder of the present invention is properly positioned for optimal ergonomic efficiency, especially with reference to a computer screen. If it is desired that the document holder not be used, then it can be separately lifted from the support member and stored. In all instances, the document holder is located in its most desirable location, that is, in front of the user of the keyboard.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A portable mini-desk comprising:
a body having a generally flat surface thereon, said body having a front end and a back end;
a legless pad means positioned on an underside of said body, said legless pad means for resting directly onto and conforming to a surface of legs of a user; and
a weight-bearing member affixed to said back end of said body and extending outwardly therefrom.

2. The mini-desk of claim 1, said body having a support structure extending upwardly therefrom adjacent said back end of said body.

3. The mini-desk of claim 1, said flat surface having a plurality of pin-receiving openings formed therein, said pin-receiving openings for removably receiving pin members therein.

4. The mini-desk of claim 3, said pin-receiving openings comprising:
a first set of pin-receiving openings extending in linear alignment at least partially from said front end toward said back end adjacent one side of said body;
a second set of pin-receiving openings extending in linear alignment at least partially from said front end toward said back end adjacent an opposite side of said body; and
a third set of pin-receiving openings extending in linear alignment at least partially from said back end toward said front end, said third set arranged between said first set and said second set.

5. The mini-desk of claim 1, further comprising:
a mouse pad removably connected to said body and extending outwardly therefrom, said mouse pad extending outwardly from one side of said body.

6. The mini-desk of claim 1, said pad being of a flexible foam material enclosed within a zippered soft case, said pad having an area generally equal to an area of said flat surface.

7. A portable mini-desk comprising:
a body having a generally flat surface thereon, said body having a front end and a back end, said body having a first support structure extending upwardly therefrom adjacent said back end of said body, said first support structure adjacent one side of said body, said body having a second support structure extending upwardly from said flat surface adjacent an opposite side of said body adjacent said back end;
a legless pad positioned on an underside of said body;
a first pin extending outwardly from said first support structure; and
a second pin extending outwardly from said second support structure.

8. The mini-desk of claim 7, each of said first and second support structures having a plurality of holes formed on a surface above and opposite said flat surface, said first and second pins removably received within said plurality of holes.

9. The mini-desk of claim 7, further comprising:
a mouse pad removably connected to said first support structure, said mouse pad extending outwardly from one side of said body.

10. The mini-desk of claim 9, said mouse pad connected by a beam to said first support structure, said beam having a frame at an end opposite said mouse pad, said frame keyed to said body.

11. The mini-desk of claim 10, said mouse pad rotatably connected to said beam, said mouse pad generally plane parallel relationship to said flat surface.

12. The mini-desk of claim 9, said mouse pad having a first arm extending outwardly therefrom, said first arm in keyed relationship to a second arm extending outwardly from a side of said body.

13. The mini-desk of claim 12, said second arm hingedly connected to said body, said second arm movable between a vertical stowed position and a horizontal deployed position.

14. A portable mini-desk comprising:
a body having a generally flat surface thereon, said body having a front end and a back end;
a legless pad positioned on an underside of said body;
a weight-bearing member affixed to said back side of said body and extending outwardly therefrom; and
a document holder member affixed to said body generally adjacent said back end of said body, said document holder member affixed to a support member extending upwardly from said flat surface, said document holder member positioned above said flat surface, said document holder member affixed in cantable relationship to said support member, said document holder member positioned generally centrally between sides of said body.

* * * * *